US011732923B2

(12) United States Patent
Zauderer et al.

(10) Patent No.: US 11,732,923 B2
(45) Date of Patent: Aug. 22, 2023

(54) AIR FLOW PRODUCER ASSEMBLY FOR CEILING MOUNTING

(71) Applicant: ACP Ltd., Yesodot (IL)

(72) Inventors: Ron Zauderer, Petah Tikva (IL); Yehuda Klein, Rehovot (IL)

(73) Assignee: ACP Ltd., Yesodot (IL)

( * ) Notice: Subject to any disclaimer, the term of this patent is extended or adjusted under 35 U.S.C. 154(b) by 364 days.

(21) Appl. No.: 17/021,103

(22) Filed: Sep. 15, 2020

(65) Prior Publication Data

US 2022/0082290 A1 Mar. 17, 2022

(51) Int. Cl.
*F24F 13/02* (2006.01)
*F24F 13/072* (2006.01)

(52) U.S. Cl.
CPC ..... *F24F 13/0254* (2013.01); *F24F 13/0227* (2013.01); *F24F 13/072* (2013.01); *F24F 2221/14* (2013.01)

(58) Field of Classification Search
CPC ..... F24F 2221/14; F24F 13/0254; F24F 13/0227; F24F 13/072
USPC ..... 454/303
See application file for complete search history.

(56) References Cited

U.S. PATENT DOCUMENTS

| | | | | |
|---|---|---|---|---|
| 3,254,587 A * | 6/1966 | Sweeney | F24F 13/072 454/299 |
| 3,308,745 A * | 3/1967 | Davies | F24F 13/072 454/304 |
| 3,733,995 A * | 5/1973 | Brown | F24F 13/072 248/343 |
| 5,215,284 A * | 6/1993 | Hungerford | F24F 13/072 454/301 |
| 2016/0334128 A1* | 11/2016 | Manasians | F24F 13/06 |

* cited by examiner

*Primary Examiner* — Allen R. B. Schult
(74) *Attorney, Agent, or Firm* — Dekel Patent Ltd.; David Klein

(57) ABSTRACT

An air flow producer assembly includes first and second elongate mounting elements separated by an elongate gap, a ceiling girder interface member affixed to each of the elongate mounting elements, and a bridge member affixed to each of the elongate mounting elements. The bridge member includes a hollow chamber that spans across the gap and which extends upwards from the elongate mounting elements. A vane assembly is installed in the hollow chamber of the bridge member, which includes a vane that swings across at least a portion of the gap.

12 Claims, 2 Drawing Sheets

AIR FLOW PRODUCER ASSEMBLY FOR CEILING MOUNTING

FIELD OF THE INVENTION

The invention relates generally to air flow producers, such as in air conditioning installations, and particularly to air flow producers adapted for installation in ceilings, such as drop ceilings.

BACKGROUND OF THE INVENTION

It is well known that warm air tends to rise toward the ceiling of a room while cooler air tends to accumulate near the floor. A ceiling-mounted air flow producer helps circulate air properly in the room and reduces vertical temperature gradients in the room.

Many ceiling-mounted air flow producers are mounted in drop ceilings. Such ceilings have a framework, usually an assembly of T-bars and hangers that suspend the T-bars from the ceiling above. The framework defines rectangular openings with standard dimensions in which ceiling panels are seated.

Typical drop ceiling air flow producers use a rectangular housing that conforms to dimensions of a seating opening and the rectangular seating structure surrounding the opening. The air flow producer may receive its air intake from a plenum box or other source. The ceiling installation must provide sufficient room to install a vane assembly for diverting the air flow in different directions in the room. The vane assembly often includes a motor to swing the vanes in different directions. The area required for accommodating the vane and motor assembly is quite large in the prior art. This is disadvantageous because a very large area must be covered by the finishing work (such as for dry wall or gypsum board installations). Furthermore, any repair or replacement of the vane and motor assembly requires a lot of work to access the assembly and to refinish the dry wall or gypsum board installation.

SUMMARY

The present invention seeks to provide a novel and improved air flow producer adapted for installation in ceilings, such as drop ceilings, as described in detail below.

There is thus provided in accordance with a non-limiting embodiment of the present invention an air flow producer assembly including first and second elongate mounting elements separated by an elongate gap, a ceiling girder interface member affixed to each of the elongate mounting elements, a bridge member affixed to each of the elongate mounting elements, the bridge member including a hollow chamber that spans across the gap and which extends upwards from the elongate mounting elements, and a vane assembly installed in the hollow chamber of the bridge member, the vane assembly including a vane that swings across at least a portion of the gap.

Two bridge members may be mounted at opposite ends of the elongate mounting elements and the vane may extend over at least a portion of a length between the two bridge members.

BRIEF DESCRIPTION OF THE DRAWINGS

The present invention will be understood and appreciated more fully from the following detailed description, taken in conjunction with the drawings in which.

DETAILED DESCRIPTION

Figure 1:
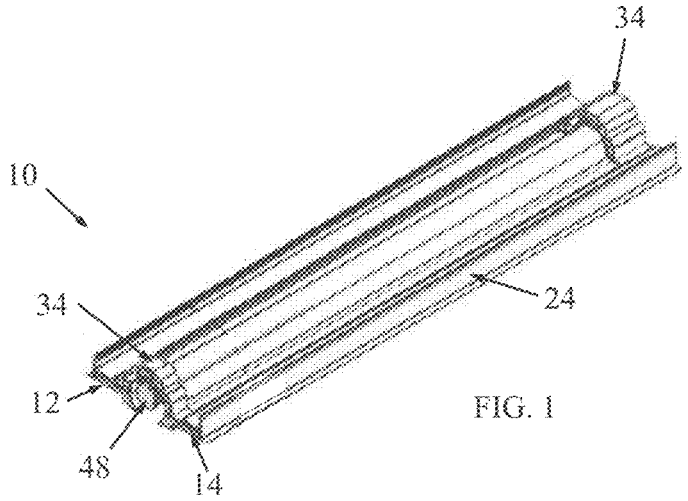
FIG. 1 is a simplified perspective illustration of an air flow producer assembly adapted for installation in a ceiling, in accordance with a non-limiting embodiment of the present invention.
Figure 2:
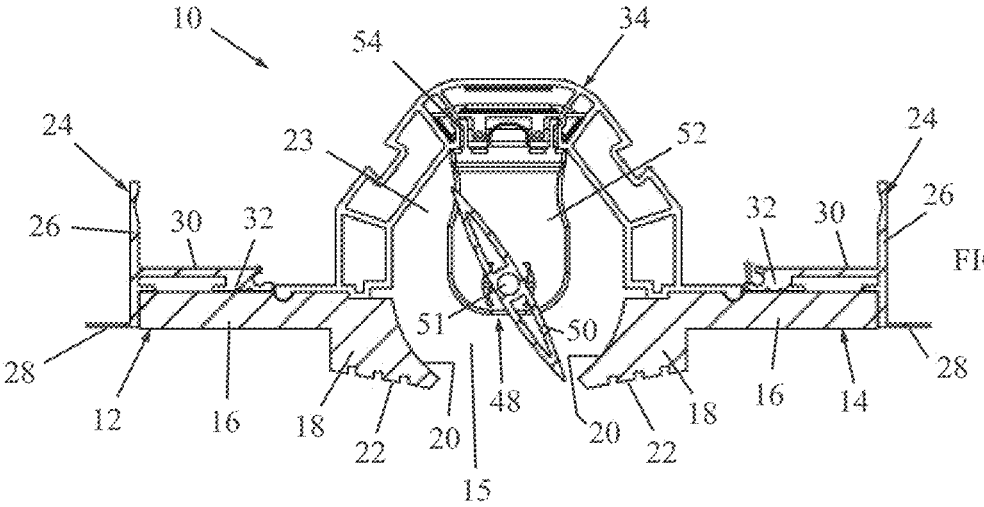
FIG. 2 is a simplified end-view illustration of the assembly, showing a motorized vane assembly installed in a bridge member.

Reference is now made to FIGS. 1 and 2, which illustrate an air flow producer assembly 10, constructed and operative in accordance with a non-limiting embodiment of the present invention.

The air flow producer assembly 10 may include first and second (e.g., left and right) elongate mounting elements 12 and 14. The first and second elongate mounting elements 12 and 14 are separated by an elongate gap 15. Each elongate mounting element may include an outer elongate board 16 from which extends an inner member 18, which may be thicker than outer elongate board 16. Inner member 18 has an upward-facing curved surface 20 and a lower tilted portion 22, which may extend below the level of the bottom of outer elongate board 16 and which may be formed with elongate grooves or other decorations.

A ceiling girder interface member 24 may be affixed to each of the elongate mounting elements 12 and 14. The ceiling girder interface member 24 may include a vertical member 26. An outer horizontal member 28 may extend perpendicularly from vertical member 26, and may be flush with the bottom surface of outer elongate board 16. An inner horizontal member 30 may extend perpendicularly from vertical member 26 on a side opposite to that of outer horizontal member 28. The inner horizontal member 30 may have a leg 32 that sits on the upper surface of outer elongate board 16.

Figure 3:
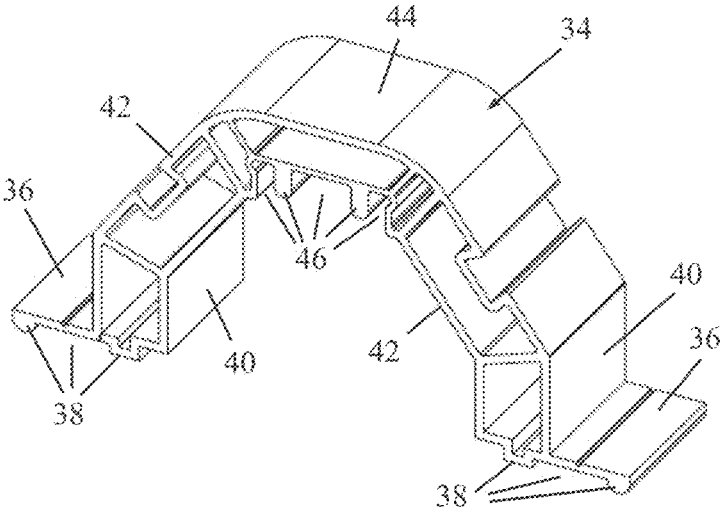
FIG. 3 is a simplified pictorial illustration of the bridge member.

In accordance with a non-limiting embodiment of the present invention, a bridge member 34 is affixed to the upper surface of outer elongate board 16. Bridge member 34 is shown and described more clearly with reference to FIG. 3. Bridge member 34 includes a hollow chamber 23 that spans across gap 15 and which extends upwards from elongate mounting elements 12 and 14. Bridge member 34 may include two outer flanges 36 that have one or more flange mounting provisions 38 for mounting on the upper surface of outer elongate board 16. For example, flange mounting provisions 38 may be male or female lugs or notches that mate with corresponding female or male notches or lugs in the upper surface of outer elongate board 16. This enables quick mounting and removal of bridge member to and from outer elongate board 16, such as by snug-fit or snap-fit.

Bridge member 34 may include two upright members 40 that extend perpendicularly from flanges 36 and two slanted members 42, each of which extends inwards from its corresponding upright member 40. A (horizontal) connecting member 44 extends between the slanted members 42. A lower face of connecting member 44 may be provided with one or more vane assembly mounting provisions 46, such as but not limited to, male or female lugs or notches.

Referring again to FIG. 2, a vane assembly 48 (which may be motorized) may be installed in bridge member 34. The vane assembly 48 may include one or more vanes or louvers 50 (the terms being used interchangeably) rotatingly mounted on an axle 51 of a motor unit 52. Vane 50 swings across at least a portion of gap 15 (FIG. 2). The motorized vane assembly 48 may be fixedly received in the vane assembly mounting provisions 46 of FIG. 3 by means of one or more fastening members 54 that mate with mounting provisions 46.

As seen in FIG. 1, two bridge members 34 may be mounted at opposite ends of elongate mounting elements 12 and 14 with the vanes of the motorized vane assembly 48 extending the length or some of the length between the two bridge members 34. The air source (e.g., plenum box or other source) may be above the air flow producer assembly 10 and is not shown in FIG. 1.

Figure 4:
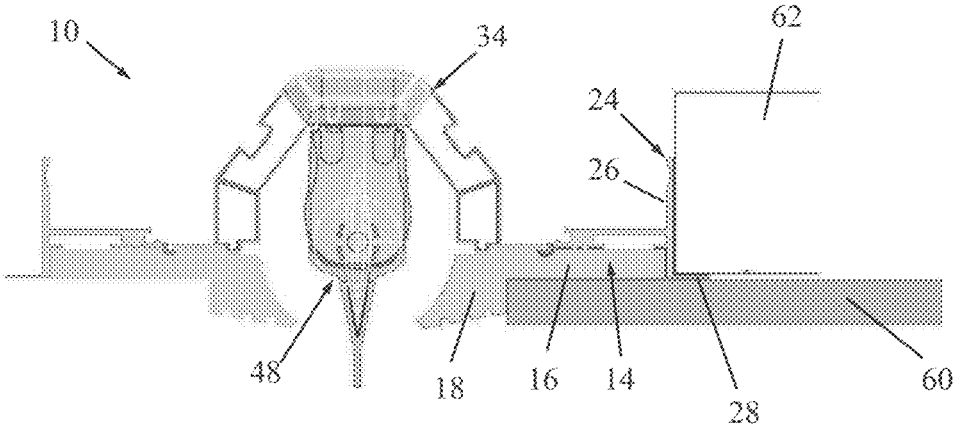
FIG. 4 is a simplified end-view illustration of the assembly, showing ceiling mounting structure.

Reference is now made to FIG. 4, which illustrates air flow producer assembly 10 installed in ceiling mounting structure. The vertical member 26 and outer horizontal member 28 of ceiling girder interface member 24 are secured against a ceiling girder 62. A finished ceiling 60 (e.g., dry wall) is made under outer elongate board 16. This is done for both left and right sides of assembly 10. The assembly 10 may be installed easily in the ceiling mounting structure with bridge member 34. Afterwards the motorized vane assembly 48 may be easily installed in bridge member 34 and can also be easily removed therefrom for repair or replacement.

What is claimed is:

1. An air flow producer assembly comprising:

first and second elongate mounting elements separated by an elongate gap;

a ceiling girder interface member affixed to each of said elongate mounting elements;

a bridge member affixed to each of said elongate mounting elements, said bridge member comprising a hollow chamber that spans across said gap and which extends upwards from said elongate mounting elements;

a vane assembly installed in said hollow chamber of said bridge member, said vane assembly comprising a vane that swings across at least a portion of said gap, wherein said vane is rotatable about a central axle and said vane comprises two wings that extend in opposite directions radially outwards from said central axle;

wherein each of said elongate mounting elements comprises an outer elongate board from when extends an inner member;

wherein each of said ceiling girder interface members comprises a vertical member and an outer horizontal member extending perpendicularly from said vertical member, wherein said outer horizontal member is flush with a bottom surface of said outer elongate board; and wherein a bottom of said inner member extends below a level of said bottom surface of said outer elongate board.

2. The air flow producer assembly according to claim 1, wherein said inner member is thicker than said outer elongate board.

3. The air flow producer assembly according to claim 1, wherein said inner member has an upward-facing curved surface and a lower tilted portion.

4. The air flow producer assembly according to claim 3, wherein said lower tilted portion extends below said level of said bottom surface of said outer elongate board.

5. The air flow producer assembly according to claim 1, wherein an inner horizontal member extends perpendicularly from said vertical member on a side opposite to that of said outer horizontal member.

6. The air flow producer assembly according to claim 1, wherein said bridge member comprises two outer flanges that have one or more flange mounting provisions for mounting on an upper surface of said outer elongate boards.

7. The air flow producer assembly according to claim 6, wherein said bridge member comprises two upright members that extend perpendicularly from said outer flanges and two slanted members, each of which extends inwards from a corresponding one of said upright members, and a connecting member that extends between said slanted members.

8. The air flow producer assembly according to claim 7, wherein a lower face of said connecting member comprises one or more vane assembly mounting provisions.

9. The air flow producer assembly according to claim 1, wherein two said bridge members are mounted at opposite ends of said elongate mounting elements and said vane extends over at least a portion of a length between the two bridge members.

10. The air flow producer assembly according to claim 1, wherein said vane is rotatingly mounted on a motor unit.

11. The air flow producer assembly according to claim 8, wherein said vane is rotatingly mounted on a motor unit fixedly received in said one or more vane assembly mounting provisions.

12. The air flow producer assembly according to claim 1, wherein said hollow chamber is defined by six sides that form a hexagon, wherein one of the six sides is open and five of the six sides are closed.

* * * * *